US012377512B2

(12) United States Patent
Pinault et al.

(10) Patent No.: US 12,377,512 B2
(45) Date of Patent: Aug. 5, 2025

(54) OPTICAL ELEMENT BLOCKING METHOD AND RELATED DEVICE

(71) Applicant: ESSILOR INTERNATIONAL, Charenton-le-Pont (FR)

(72) Inventors: Sébastien Pinault, Charenton-le-Pont (FR); Luc Martin, Charenton-le-Pont (FR); Caroline Ho, Charenton-le-Pont (FR)

(73) Assignee: Essilor International, Charenton-le-Pont (FR)

( * ) Notice: Subject to any disclaimer, the term of this patent is extended or adjusted under 35 U.S.C. 154(b) by 637 days.

(21) Appl. No.: 17/763,964

(22) PCT Filed: Sep. 24, 2020

(86) PCT No.: PCT/EP2020/076647
§ 371 (c)(1),
(2) Date: Mar. 25, 2022

(87) PCT Pub. No.: WO2021/058612
PCT Pub. Date: Apr. 1, 2021

(65) Prior Publication Data

US 2022/0339752 A1 Oct. 27, 2022

(30) Foreign Application Priority Data

Sep. 27, 2019 (EP) ..... 19306216

(51) Int. Cl.
*B24B 13/005* (2006.01)

(52) U.S. Cl.
CPC ..... *B24B 13/0052* (2013.01)

(58) Field of Classification Search
CPC ..... B24B 13/0052; B24B 13/0057; B24B 13/005; B23Q 3/08; B23Q 3/084; H05B 6/02–44

(Continued)

(56) References Cited

U.S. PATENT DOCUMENTS 5,763,075 A * 6/1998 Benjamin ..... C09J 7/22 451/384
6,036,313 A * 3/2000 Benjamin ..... B24B 13/0057 451/384
8,382,932 B2 * 2/2013 Savoie ..... C09J 133/10 451/384

FOREIGN PATENT DOCUMENTS

DE 10 2007 007 161 8/2008
DE 102007007161 A1 * 8/2008 ..... B24B 13/005
WO 2009/003660 1/2009

OTHER PUBLICATIONS

Machine translation of DE-102007007161-A1 (Year: 2008).*

(Continued)

*Primary Examiner* — Robert F Neibaur
(74) *Attorney, Agent, or Firm* — NIXON & VANDERHYE

(57) ABSTRACT

A method for blocking an optical element on an insert of a blocking device including: providing the insert of the blocking device, the insert being blocked in respect with the blocking device; providing thermoplastic material in a solid state in a first particulate form, the provided thermoplastic material having a feature included in an operating range; heating at least a part of the provided thermoplastic material at a temperature at which the thermoplastic material is in a melted state and flows under moderate pressure; providing on the insert an amount of the heated thermoplastic material for blocking one optical element; placing the optical element onto the thermoplastic material in the melted state; allowing the thermoplastic material to solidify, thereby blocking the optical element on the insert; converting the solidified thermoplastic material into a second particulate form, the converted thermoplastic material being intended to block another optical element.

8 Claims, 5 Drawing Sheets

(58) Field of Classification Search
USPC ..... 451/42, 384, 380, 390, 921; 269/20, 21; 156/309.6
See application file for complete search history.

(56) References Cited

OTHER PUBLICATIONS

International Search Report for PCT/EP2020/076647 dated Jan. 31, 2021, 3 pages.
Written Opinion of the ISA for PCT/EP2020/076647 dated Jan. 31, 2021, 7 pages.

* cited by examiner

OPTICAL ELEMENT BLOCKING METHOD AND RELATED DEVICE

This application is the U.S. national phase of International Application No. PCT/EP2020/076647 filed Sep. 24, 2020 which designated the U.S. and claims priority to EP 19306216.3 filed Sep. 27, 2019, the entire contents of each of which are hereby incorporated by reference.

FIELD

This invention relates to an optical element blocking method and device for use in blocking an optical element to an insert employed with machining, grinding and processing equipment in the generation of optical, namely ophthalmic, lenses.

BACKGROUND

The process of preparing optical or ophthalmic lenses begins usually with an unfinished or semi-finished glass or plastic lens blank. Typically, a semi-finished lens blank has a finished polished front surface and an unfinished back surface. By grinding away material from the back surface of the lens blank the required corrective prescription is generated. Thereafter the surface having had the corrective prescription imparted thereto is polished and the peripheral edge of the thus processed lens blank is provided with a final desired contour thereby establishing a finished optical or ophthalmic lens. According to other processing methods, the finished ophthalmic lens can be directly processed from a lens blank using for example three directional machining. The lens blank can be either a plastic or a glass lens blank.

It is necessary during these various processing operations to securely maintain the lens blank in accurate alignment and in place on the lens blocking device. This procedure is often referred to as "lens blocking".

Heretofore various materials were employed to secure the lens blank to the lens blocking device. These materials include glues, pitch and low temperature fusible metal alloys. The use of glues and pitch, in addition to being messy, suffers the further disadvantage of generally being non-reusable or non-reclaimable. The use of low temperature metal alloys caused significant environmental and health hazards especially since these alloys were most often fabricated from such metals as cadmium, tin, lead and bismuth.

To overcome these issues, organic low shrinkage materials have been developed to be used as lens blocking materials.

Application U.S. Pat. No. 6,036,313 in the name of 3M Innovative Properties Company discloses examples of compound families suitable for lens blocking with thermoplastic materials. The disclosed blocking compositions have many advantages over traditional metal alloy materials. For example, the lens blocking compositions are non-toxic, environmentally safe, preferably biodegradable. Further, the disclosed thermoplastic materials are non-crosslinkable, that is to say that, by heating it again becomes fluid again and can be reused.

However, the inventors have noticed that the ageing of the warmed thermoplastic material causes undesirable side effects including non-manageable thermoplastic material residues on front surface of the lenses.

Accordingly, there is a need for improving blocking an optical element secured to an insert of a blocking device thanks to a thermoplastic material, in particular in order to avoid the bad effects of the ageing of the thermoplastic material.

One solution could be to use fresh thermoplastic material at each blocking process. However, this solution would not be economic and ecological.

Thus, the goal of the present disclosure is to improve method for blocking an optical element secured to an insert with thermoplastic material in an eco-responsible approach.

SUMMARY

The goal is obtained according to the present disclosure thanks to a method for blocking an optical element on an insert of a blocking device comprising:

- providing the insert of the blocking device, the insert being blocked in respect with the blocking device;
- providing thermoplastic material in a solid state in a first particulate form, the provided thermoplastic material having a feature comprised in an operating range;
- heating at least a part of the provided thermoplastic material at a temperature at which the thermoplastic material is in a melted state and flows under moderate pressure;
- providing on the insert an amount of the heated thermoplastic material for blocking one optical element;
- placing the optical element onto the thermoplastic material in the melted state;
- allowing the thermoplastic material to solidify, thereby blocking the optical element on the insert;
- converting the solidified thermoplastic material into a second particulate form, the converted thermoplastic material being intended to block another optical element.

By converting the solidified thermoplastic material into a particulate form, it leads to consumable savings and an eco-responsible approach.

Indeed, it is particularly interesting to use thermoplastic material in particulate form and to convert the solidified thermoplastic material in particulate form. Advantageously, the particulate form allows controlling the amount of used thermoplastic material and using just the needed amount of thermoplastic. Thus, this method avoid using/heating the thermoplastic material unnecessarily and consequently allows to prevent premature ageing of thermoplastic material.

This further reduces energy consumption and simplifies the manufacturing process. The particulate form may be for example particle, granulate, rod, powder, block or cube.

The size of particulates may be comprised between 1 mm and 5 mm, preferably between 1 mm and 2 mm. When the size of the particulate is between 1 mm and 2 mm, the time to convert the thermoplastic material in this size of the particulates and the time to melt it homogeneously, are short. Indeed, the time to convert decreases with the increasing size of the particulates while the time to homogeneously melt increases with the increasing size of the particulates.

The first particulate form and the second particulate form may be substantially similar in size and/or in weight of the particle. The term "substantially" means that the difference in size or weight of the particle may be at maximum +/−10%.

Moreover, a particulate form allows the thermoplastic material to be quickly heated and homogeneously melted. Besides it offers a good compromise between time for converting and time needed to obtain a homogeneously melted material.

In the present disclosure, "by operating range" means a range in which the thermoplastic material allows the optical lens to be blocked without or very limited undesirable side effects such as residues on front surface of optical element after deblocking.

According to further embodiments, which can be considered alone or in combination, the method for blocking an optical element comprises further:

measuring the feature of the thermoplastic material;

comparing the measured feature with the operating range;

if the measured feature is not comprised in the operating range, mixing a first amount of thermoplastic material in the first particulate form and a second amount of the converted thermoplastic material in the second particulate form.

The mixing of a first amount of thermoplastic material in the first particulate form and a second amount of the converted thermoplastic material in the second particulate form is such that the mixed thermoplastic material has the feature comprised in the operating range and such as the mixed thermoplastic material is the provided thermoplastic material.

Advantageously, this method allows the management of the ageing of the thermoplastic material by controlling and optimizing the feature of the thermoplastic material. Thus, the undesirable side effects including non-manageable thermoplastic material residues on front surface of the optical element are eliminated or at least considerably reduced. At the same time, refilling of fresh thermoplastic material is controlled and reduced, thereby leading to consumable savings and an eco-responsible approach.

In contrast with the prior art, the method is optimized for the preservation of the thermoplastic material which leads to obtain lenses with a very high quality ensuring an ecological approach.

The feature may be any feature which depends on the thermal degradation kinetics of the thermoplastic material. The thermal degradation kinetics of the thermoplastic material correspond to the chemical ageing during which an irreversible structural change of the macromolecular network takes place. The feature may be optical, physical or chemical such as, for example, molecular weight, change of transformation points, change in chemical composition, viscosity, colors, storage and relaxation moduli, adhesive, optical-colorimetry, chemistry-oxidation, cohesive strength and shear strength.

The feature of the thermoplastic material may be measured in the melted state or the solid state. In the case of the viscosity, the feature may be measured in the melted state.

Preferably, the feature may be the viscosity of the thermoplastic material. Advantageously, the viscosity of the thermoplastic material is a property which can be measured easily in real time.

Said converting the thermoplastic material may comprise simultaneously said mixing the first amount of thermoplastic material with the second amount of thermoplastic material in the solid state.

Alternatively, said mixing may be deferred and may be realized after said converting.

According to further embodiments, which can be considered alone or in combination, the heated thermoplastic material corresponds to an amount of thermoplastic material for blocking a single optical element.

Advantageously, this embodiment may be very attractive for manual manufacturing wherein the productivity rate is low and consequently, the needed amount of thermoplastic material may be very light.

According to further embodiments, which can be considered alone or in combination, the heated thermoplastic material corresponds to an amount of thermoplastic material for blocking less than 20 optical elements, preferably 10 optical elements.

Advantageously, this embodiment allows the productivity to be increased without reducing the quality of the blocking step and consequently of the resulting optical element. This embodiment may be very attractive for high production rates such as automatic manufacturing.

By determining and controlling the amount of heated thermoplastic material, this method better allows prevention of premature ageing of thermoplastic material by heating only a determined amount of thermoplastic material. Moreover, by managing the amount of heated thermoplastic material, the preservation of the thermoplastic material is optimized.

According to a second aspect, the disclosure relates to a method for machining at least one optical element comprising:

blocking one optical element according to the present disclosed method wherein next to said allowing the thermoplastic material to solidify and before said converting the thermoplastic material, the method for machining comprises:

machining the blocked optical element;

deblocking the machined optical element from the insert;

removing the thermoplastic material from the machined optical element.

Advantageously, the thermoplastic material is recycled, thereby applying an eco-responsible approach. Furthermore, the inventors have noticed that ophthalmic lenses manufactured using the blocking method according to the present invention have undamaged and quality reliable optical surfaces.

According to further embodiments which can be considered alone or in combination, the method for machining further comprises using the thermoplastic material in the second form for machining another optical element.

According to a third aspect, the present description further relates to a blocking system for blocking one optical element on an insert of a blocking device, the blocking system comprising:

at least one blocking device which comprises the insert having a surface intended to be blocked against a face of one optical element, a receiver configured to contain thermoplastic material in a solid state in a first particulate form, a heater configured to heat at least a part of the thermoplastic material at a temperature at which the thermoplastic material is in a melted state and flows under moderate pressure, a nozzle configured to dispense the thermoplastic material in the melted state onto the surface of the insert wherein after placing the optical element, the thermoplastic material solidifies, thereby blocking the optical element on the insert; and a converter configured to convert the solidified thermoplastic material into a second particulate form.

This blocking system leads to consumable savings and an eco-responsible approach.

Advantageously, the particulate form allows controlling the amount of used thermoplastic material and using just the needed amount of thermoplastic. Thus, this method avoid using/heating the thermoplastic material unnecessarily and consequently allows to prevent premature ageing of thermoplastic material.

Further, the configuration of this blocking system allows the converter to be mutualized for several blocking system, thereby leading to reduction of energy consumption and simplification of the manufacturing process.

In one or more embodiments, the converter may be a mechanical converter or a thermal converter or both.

Advantageously, a mechanical converter allows reshaping directly after deblocking since remelt of thermoplastic material is not needed. This allows a quicker reprocessing while preventing additional ageing of thermoplastic material. On the other hand, a thermal converter allows a wider range of forms of particulate and would be required for reshaping into blocks or rods for example.

In one or more embodiments, the receiver may be a buffer, a tank, a container, a reservoir, any element or place where the thermoplastic material in the first form may be collected, accumulated or contained.

In one or more embodiments, the heater may be a heating system or a melting system or any device that heats/melts and optionally mixes the thermoplastic material such as an induction heater, an induction heating spiral, an infrared heater or a dielectric heater for example.

In one or more embodiments, the nozzle may be a dosing nozzle or a nozzle with a flowmeter or any device which can dispense flowed thermoplastic material onto the insert. In one or more embodiments, the blocking system comprises further a measurement device configured to measure at least one feature of the thermoplastic material.

The measurement device may be a viscometer paired with the receiver, in the heater, in the nozzle or at the output of the nozzle.

The measurement device may be a viscometer, consistometer or any similar device.

According to further embodiments which can be considered alone or in combination, the blocking system comprises a mixer configured to mix a first amount of thermoplastic material in the first particulate form and a second amount of the converted thermoplastic material in the second particulate form.

According to further embodiments which can be considered alone or in combination, the heater is configured to heat an amount of thermoplastic material for blocking less than 20 optical elements, preferably 10 optical elements.

According to further embodiments which can be considered alone or in combination, the heater is configured to heat an amount of thermoplastic material for blocking a single optical element.

The heater may be configured for example in shape, in size, in material.

In one or more embodiments, the receiver is disposed in the nozzle and/or the heater is disposed around the nozzle. That allows a very compact device to be obtained.

According to further embodiments which can be considered alone or in combination, the method for machining an optical element uses the blocking device as described by the present disclosure.

In the present disclosure, the thermoplastic material layer is a layer of material that can melt or soften when being heated. A thermoplastic material can be remelted or softened when heated and remoulded when cooling after melting or softening. Most thermoplastics are high molecular weight polymers whose chains associate through weak van der Waals forces (polyethylene); strong dipole-dipole interactions and hydrogen bonding (nylon); or even stacking of aromatic rings (polystyrene). Many thermoplastic materials are addition polymers; e.g., vinyl chain-growth polymers such as polyethylene and polypropylene. The thermoplastic material may also comprise additives (such as, for example, plasticizers, stabilizers, pigments, . . . ) and/or fillers (such as mineral and/or organic fillers, as for examples boron, carbon, clay, glass, cellulose, metals, oxides, aramide, polyamide, . . . ; fillers may be of different geometry, such as for example grains, lamella, short or long fibers, nanoparticles . . . ).

In the present disclosure, an "optical element" may be an optical lens, a lens which surfaces have already been machined, a semi-finished lens blank with a polished front surface, a lens blank with two unfinished surfaces.

The optical element can be made of for example, but not limited to, plastic or glass. More generally, any combination of material suitable to obtain an optical system may be used. One or two surfaces of the optical lens may be coated.

Thus an "optical element" can be every optical part that needs to be machined, as for example to be surfaced and/or cut and/or grinded and/or polished and/or edged and/or engraved, in order to provide a machined optical lens.

According to the present disclosure, an "insert" may be an optical element holding unit employed with machining, grinding, and processing equipment in the generation of optical. A fully machined optical lens is for example an ophthalmic lens which surfaces form an optical system that fits a desired prescription. Said machined optical lens can be edged when blocked according to the present invention or edged in a further processing step, as for an example edged by an eye care practitioner.

The wording "upper" or "on" and "bottom" or "under" indicates positions relative to the ophthalmic lens component when it is placed so as the edge of the ophthalmic lens component to be machined is substantially situated in a horizontal plane.

Said position is purely conventional and the ophthalmic lens component can be machined in a non-horizontal position.

BRIEF DESCRIPTION OF THE DRAWINGS

For a more complete understanding of the description provided herein and the advantages thereof, reference is now made to the brief descriptions below, taken in connection with the accompanying drawings and detailed description, wherein like reference numerals represent like parts.

Figure 1:
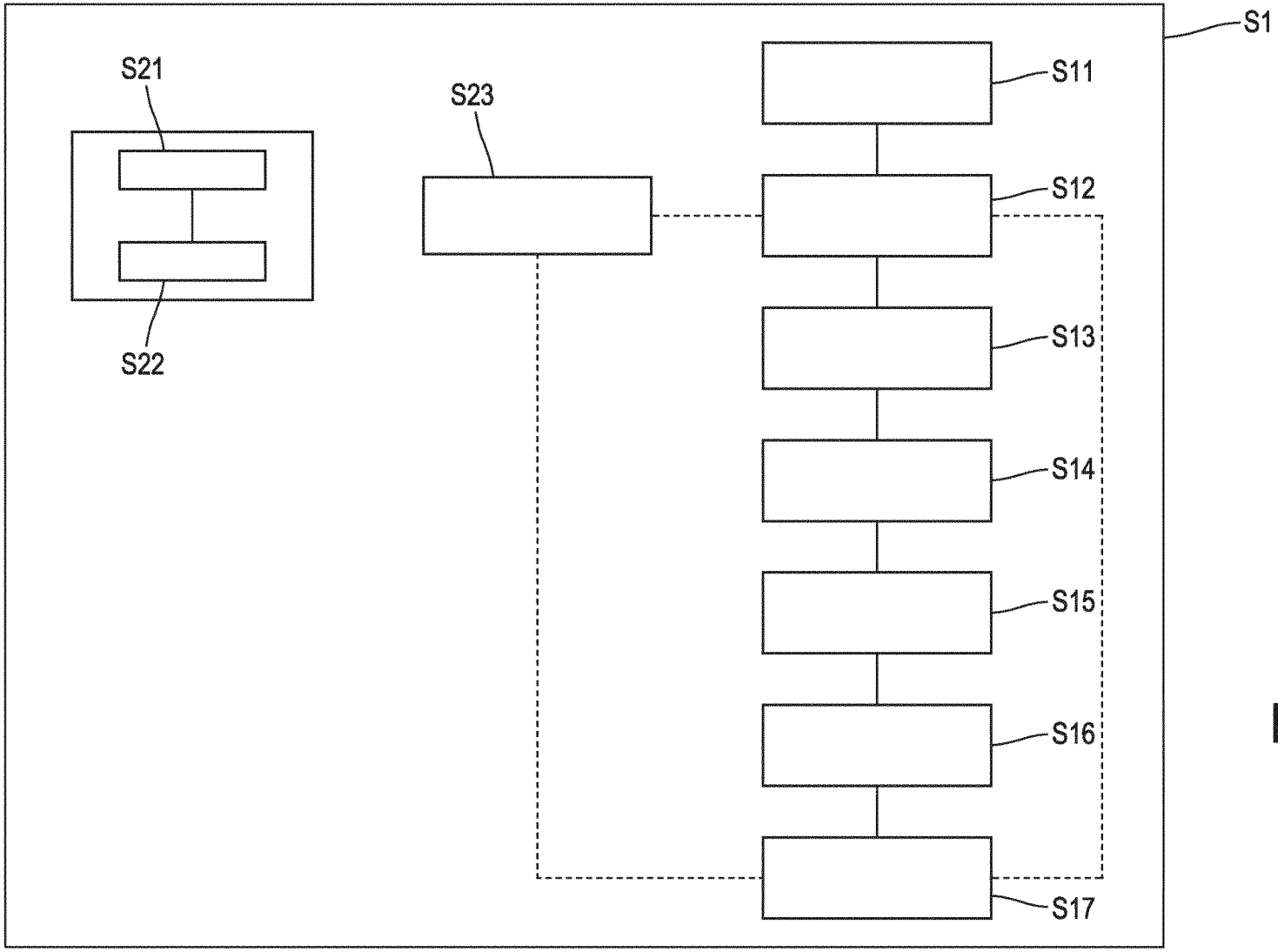
FIG. 1 is a schematic functional diagram of the method for blocking at least one optical element according to one example of the present description.

Skilled artisans appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention.

DETAILED DESCRIPTION OF EMBODIMENTS

In the description which follows the drawing figures are not necessarily to scale and certain features may be shown in generalized or schematic form in the interest of clarity and conciseness or for informational purposes. In addition, although making and using various embodiments are discussed in detail below, it should be appreciated that as described herein are provided many inventive concepts that may be embodied in a wide variety of contexts.

Embodiments discussed herein are merely representative and do not limit the scope of the invention. It will also be obvious to one skilled in the art that all the technical features that are defined relative to a process can be transposed, individually or in combination, to a device and conversely, all the technical features relative to a device can be transposed, individually or in combination, to a process.

To avoid unnecessary details for practicing the invention, the description may omit certain information already known to those skilled in the art.

FIG. 1 illustrates a schematic functional diagram of the method for blocking S1 an optical element according to one example of the present description.

The optical element has a first face to be machined as for an example to be surfaced and/or grinded and/or polished, and a second face to be blocked by a thermoplastic material onto an insert of a blocking device. The optical element can be further edged.

According to an embodiment, the first face of the optical element may be a semi-finished lens blank and the second face of the optical element is a finished optical surface.

The insert is a holding unit intended to be employed to position the optical element on a machining, grinding, and processing equipment. The insert is blocked in respect with the blocking device. The insert has a first surface intended to be blocked against the second face of the optical element and a second surface comprising means to orientate the insert in corresponding orienting means of a tool of a lens machining unit. When the optical element is blocked on the insert in an accurate position and orientation in respect with the insert, the insert with the optical element may be movable to be employed on a machining, grinding, and processing equipment.

First of all S1, the insert is provided in order to be secured in respect with the blocking device as explained above.

Then, the thermoplastic material is provided in a solid state in a first particulate form. The thermoplastic material may be provided S12 for example by a volumetric batcher in a receiver, a flow or level sensor, a weight sensor.

The particulate form may be for example particle, granulate, rod, powder, block or cube.

The size of particulates may be comprised between 1 mm and 5 mm, preferably between 1 mm and 2 mm. When the size of the particulate is between 1 mm and 2 mm, the time to convert the thermoplastic material in this size of the particulates and the time to melt it homogeneously, are short. Indeed, the time to convert decreases with the increasing size of the particulates while the time to homogeneously melt increases with the increasing size of the particulates.

The first particulate form and the second particulate form may be substantially similar in size and/or in weight of the particle. The term "substantially" means that the difference in size or weight of the particle may be at maximum +/−10%.

The thermoplastic material has a feature comprised in an operating range.

The feature may be any feature which depends on the thermal degradation kinetics of the thermoplastic material. The thermal degradation kinetics of the thermoplastic material correspond to the physico-chemical ageing during which an irreversible structural change of the macromolecular network takes place. The effects of thermal degradation depend on the thermoplastic material nature and the ageing condition. The extent of thermal degradation also depends on process parameters, such as operating temperature and time spent at this operating temperature. The feature may be optical, physical, chemical or physico-chemical such as, for example, molecular weight, change of transformation points, change in chemical composition, viscosity, colors, storage and relaxation moduli, adhesive and cohesive strength, shear strength.

The feature of the thermoplastic material may be measured in the melted state or the solid state. In the case of the viscosity, the feature may be measured in the melted state.

Preferably, the feature may be the viscosity of the thermoplastic material. Advantageously, the viscosity of the thermoplastic material is a property which can be measured easily in real time.

"Operating range" means a range in which the thermoplastic material allows the optical lens to be blocked without or very limited undesirable side effects such as residues on front surface of optical element after deblocking. The operating range of each feature is beforehand determined from reference curves as illustrated in FIG. 2A according to the requirements of the operation. In particular a threshold not to cross in order to stay in the operating range is determined.

FIG. 2A is a schematic graph which illustrates an example of a measured feature of a thermoplastic material as a function of the ageing time of the thermoplastic material. The value of the measured characteristic 31 tends to decrease with the aging time. When the value of the measured feature 31 falls under a determined threshold 32, the thermoplastic material is considered to be beyond the operating range. Thus, the thermoplastic material needs to be kept within the operating range with regards to its ageing state in order to be operational to block an optical element on an insert. In particular FIG. 2A illustrates the evolution of the viscosity as a function of ageing time. Samples at each ageing time were used to block lenses in order to detect deviation in quality of surfaced lenses, which signals the threshold in thermal ageing. The viscosity of the same samples with different ageing time was measured to plot the reference curve, which is then associated with the thermal ageing threshold to determine the operating range of the thermoplastic material.

After providing S12 thermoplastic material in a solid state, the thermoplastic material is heated to melt or soften at a low temperature S13, below the temperature at which the material(s) of the lens component may degrades or flows. Preferably the melting or softening point of the thermoplastic material is between 45° C. and 75° C. Suitable thermoplastic material may be selected from the group consisting of polyesters, polyurethanes, ionomer resins of ethylene copolymers, polyester-polysiloxane block copolymers, segmented copolyesters and polyetheresters, ethylene vinyl acetate resins and copolymers, waxes, polycaprolactones, and blends thereof.

Said thermoplastic material may comprise a homopolymer or copolymer of epsilon-caprolactone or any other types of caprolactone.

Examples of thermoplastic materials are given in previously cited U.S. Pat. No. 6,036,313 and are suitable for the present invention.

The melted thermoplastic material may be provided onto the first surface of the insert by, for example, a nozzle S14. When the melted thermoplastic material corresponds to an amount to block more than one optical element, the nozzle may be a dosing nozzle or a nozzle with a flowmeter in order to provide the amount necessary to block one optical element.

At the next step, the optical element may be placed onto the dispensed thermoplastic material S15 manually or automatically for example thanks to a blocking head with mechanical handling which is able to pick up the optical element and place it at a blocking position and blocking orientation in terms of distance, angle and centering from the insert.

After placing the optical element onto the thermoplastic material, the thermoplastic material solidifies by cooling at room temperature or with a cooling device.

Figure 3:
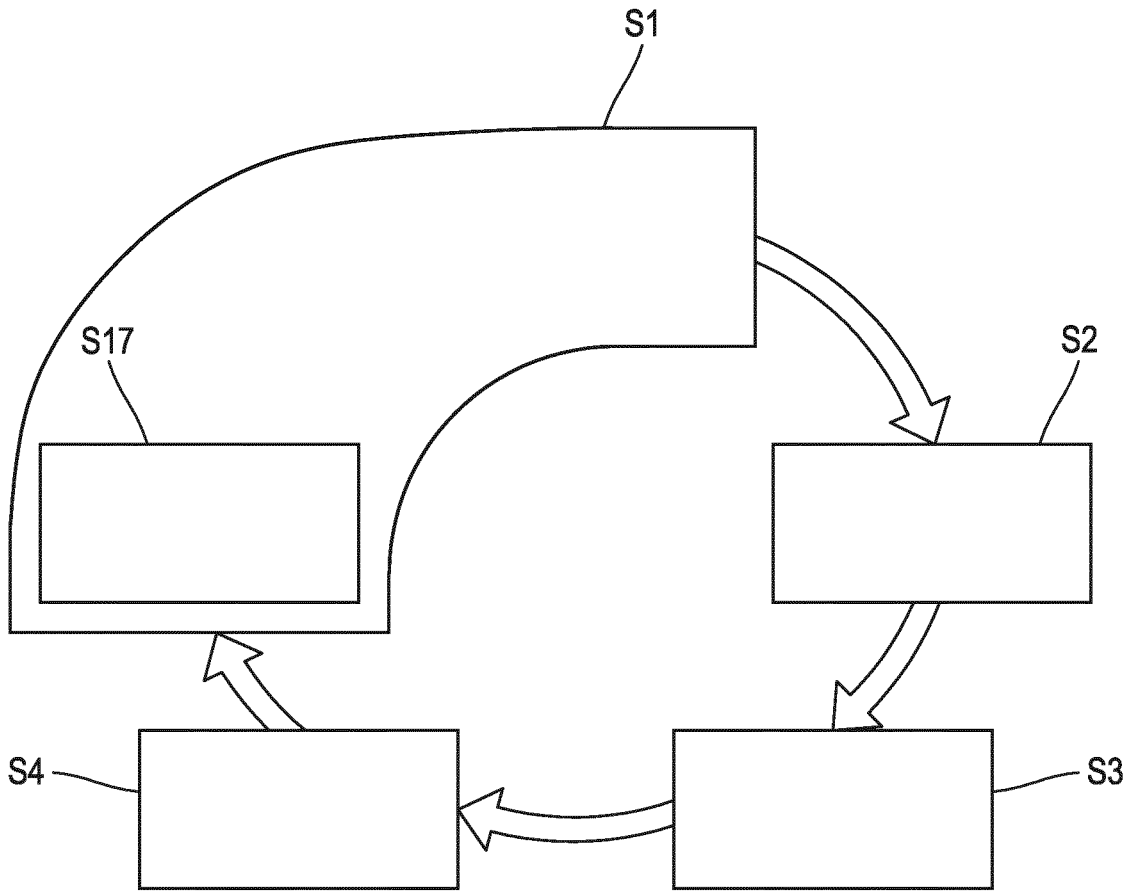
FIG. 3 is a schematic functional diagram of the method for manufacturing at least one optical element according to one example of the present description

FIG. 3 illustrates a method for machining at least one optical element comprising blocking at least one optical element S1 as described above, thereby ensuring support and anchoring of optical element on the insert during machining.

As illustrated FIG. 3, when the thermoplastic material solidifies, the optical element is blocked onto the insert. Thus the optical element is machining S2 such as to be surfaced and/or cut and/or grinded and/or polished and/or edged and/or engraved, in order to provide a machined optical lens.

Afterwards, the machined optical element is deblocked from the insert S3 and the thermoplastic material is removed from the machined optical element S4.

Then, the removed thermoplastic material is converted into a second particulate form S17, the converted thermoplastic material being intended to block another optical element.

For that, pieces of removed thermoplastic material are manually or automatically collected in a container or a pipe that would then feed the converter to generate the second particulate form, which is provided into the receiver.

According to further embodiments which can be considered alone or in combination, the first form and the second form may be different, for example the first form and the second form may be both in a granulated form with different size or, for example, the first form is a granulate form and the second form is a cube form.

The first particulate form and the second particulate form may be substantially similar in size and/or in weight of the particle. The term "substantially" means that the difference in size or weight of the particle may be at maximum +/−10%.

According to one or more embodiments, at any step of the method for blocking an optical element, the method may comprise the steps of:

- measuring S21 the feature of the thermoplastic material;
- comparing S22 the measured feature with the operating range;
- if the measured feature is not comprised in the operating range, mixing S23 a first amount of thermoplastic material in the first particulate form and a second amount of the converted thermoplastic material in the second particulate form such that the mixed thermoplastic material has the feature comprised in the operating range and such as the mixed thermoplastic material is the provided thermoplastic material.

Figure 2B:
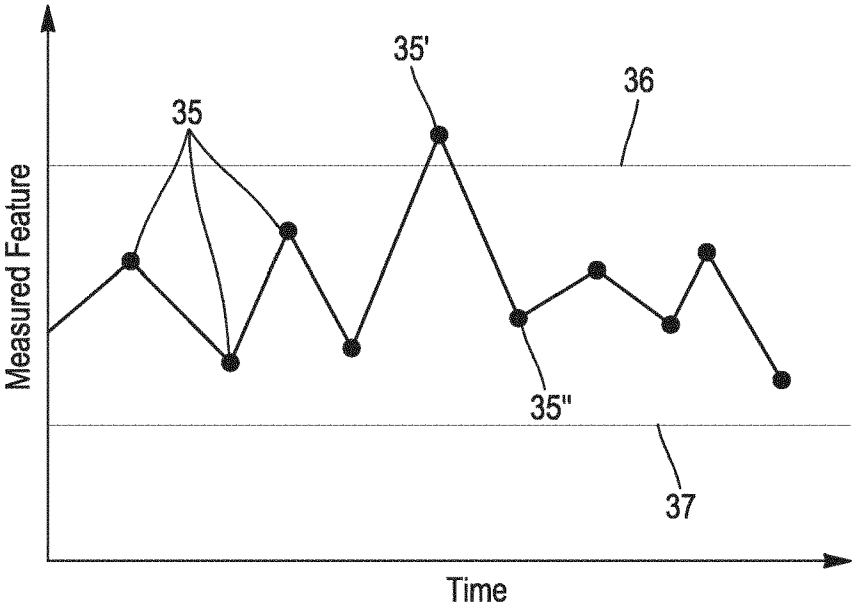
FIG. 2B is a graph representing the measurement of the feature according to the time during several blocking process.
Figure 2A:
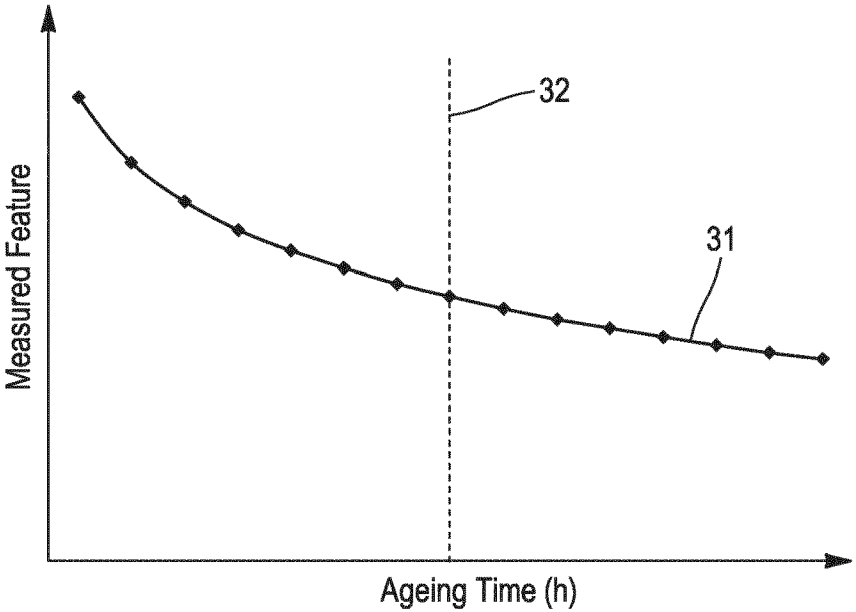
FIG. 2.A is a graph representing a measured feature as a function of the ageing time

FIG. 2B illustrates a schematic graph representing the measures 35, 35', 35" of the feature as function of the time. The lines 36 and 37 represent the operating range.

The measured features 35 are comprised in the operating range 36, 37. In this case, the converted thermoplastic material can be directly used for another optical element to be blocked.

The measured feature 35' is not comprised in the operating range 36, 37. In this case, a first amount of thermoplastic material in the first particulate form is mixed with a second amount of the converted thermoplastic material in the second particulate form. The first amount of thermoplastic material may be fresh thermoplastic material. The ratio between the first amount and the second amount is determined such that the mixed thermoplastic material has the feature comprised in the operating range. This mixed thermoplastic material is the provided thermoplastic material for another optical element to be blocked.

In other words, as explained before, the ground thermoplastic material may be mixed with fresh thermoplastic material into particulate form according to predetermined proportions to form the thermoplastic material used during the blocking process.

For example, as explained before, when the viscosity of the ground thermoplastic material shifts and exceeds the recommended limits, it is possible to reinsert the virgin pellets in order to bring the viscosity of the thermoplastic material within the limit values mentioned above. It then adjusts the proportion of converted thermoplastic material and fresh thermoplastic material so that the viscosity remains between predefined limits.

Said converting the thermoplastic material may comprises simultaneously said mixing the first amount of thermoplastic material with the second amount of thermoplastic material in the solid state.

Alternatively, said mixing may be deferred and may be realized after said converting.

According to one or more embodiments, the heated thermoplastic material corresponds to an amount of thermoplastic material for blocking a single optical element. For that, for example, the desired shape and size of the thermoplastic material layer between the second face of the optical element to be blocked and the first surface of the insert is determined according to the prescription of the wearer and the size of the chosen frame. This leads to a chosen curvature of semi-finished lens and a chosen curvature of the insert. The curvature of insert should match curvature of semi-finished lens while limiting risks of deblocking during machining. Finally the thermoplastic material thickness is optimized to provide enough support during machining while reducing process time during blocking step.

According to another embodiment, the heated thermoplastic material corresponds to an amount of thermoplastic material for blocking less than 20 optical elements, preferably 10 optical elements.

Thanks to the particulate form, it is easy to provide the needed amount of thermoplastic material. Thus, the thermoplastic material heated is just the amount needed for a specific purpose. That presents the advantage to 'melt on demand' allowing to only melt the amount needed and to optimize the management of ageing thermoplastic material and the amount of fresh thermoplastic material. It may involve whether a direct re-use of the converted thermoplastic material or a mix of solidified thermoplastic material with fresh thermoplastic material.

Figure 4A:
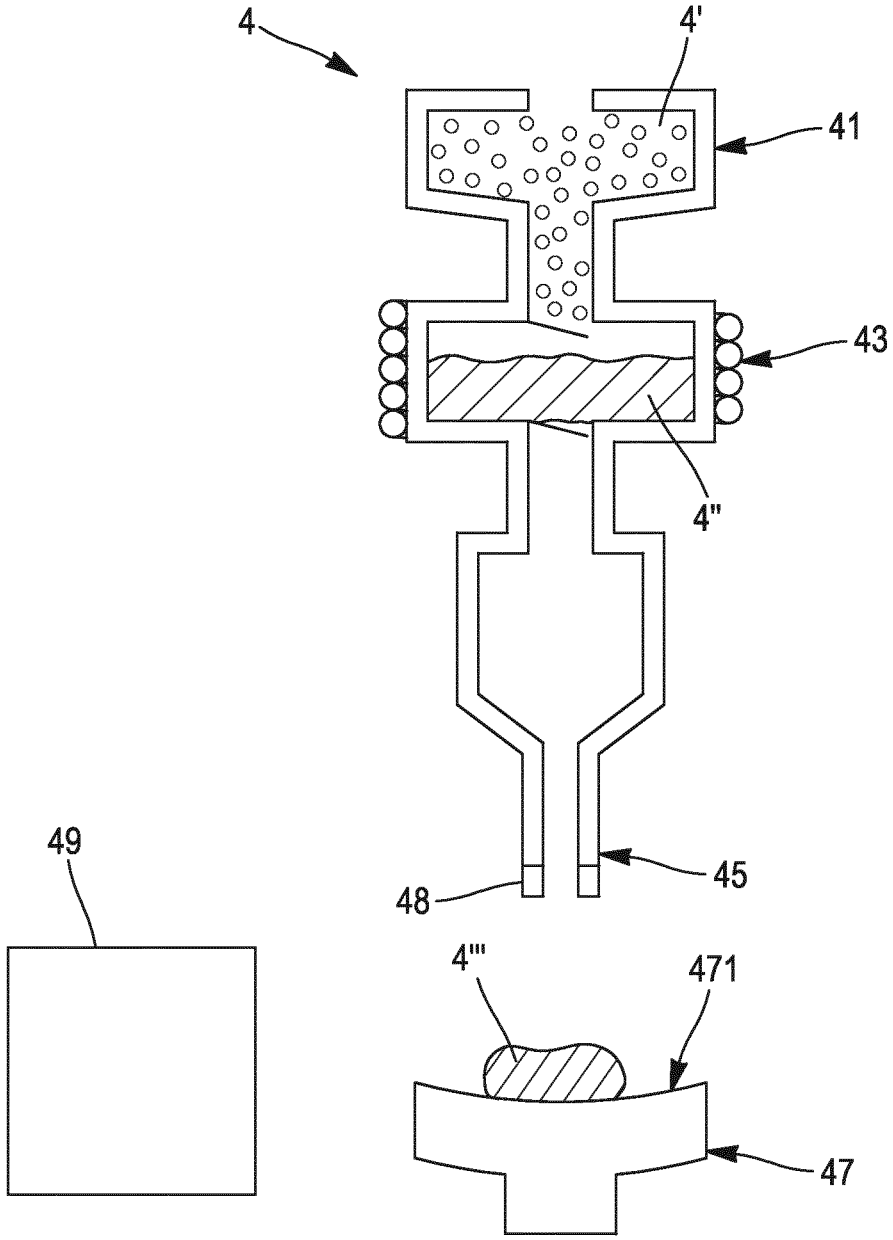
FIG. 4A and FIG. 4B show two schematic views of blocking device according to two examples of the present description.

FIG. 4A shows an embodiment of blocking device 4 suitable to be used for the method according to the present description. The blocking device comprises:

- at least one blocking device which comprises
- the insert 47 having a surface 471 intended to be blocked against a face of one optical element,
- a receiver 41 configured to contain thermoplastic material in a solid state in a first particulate form, a heater 43 configured to heat at least a part of the thermoplastic material at a temperature at which the thermoplastic material is in a melted state and flows under moderate pressure, a nozzle 45 configured to dispense the thermoplastic material in the melted state onto the surface 471 of the insert 47 wherein after placing the optical element, the thermoplastic material solidifies, thereby blocking the optical element on the insert; and a converter 49 configured to convert the solidified thermoplastic material into a second particulate form.

The configuration of this blocking system allows the converter to be mutualized for several blocking system, thereby leading to reduction of energy consumption and simplification of the manufacturing process.

The insert 47 is a holding unit which may be metallic or polymeric (acrylic resin for example). The insert has a first surface 471 intended to be blocked against a face of the optical element and a second surface comprising means to orientate the insert in corresponding orienting means of a tool (not represented) of an optical element machining unit such as a lathe or another movement inducing machine.

The receiver 41 may be a buffer, a tank, a container, a reservoir, any element or place where the thermoplastic material in the first form may be collected, accumulated or contained.

The heater 43 may be a heating system or a melting system or any device that heats/melts and optionally mixed a determined amount of thermoplastic material.

The heater may be configured to heat an amount of thermoplastic material for blocking a single optical element or to heat an amount of thermoplastic material for blocking less than 20 optical elements, preferably 10 optical elements.

The heater may be configured for example in shape, in size, in material.

The dimension of the receiver and the heater may depend on: kinetics of heating, productivity, average volume for a lens.

The nozzle 45 may be a dosing nozzle or a nozzle with a flowmeter or any device which can dispense flowed thermoplastic material onto the insert.

The converter 49 may be a mechanical converter or a thermal converter or both or any device which transforms the solidified thermoplastic material into a second form.

According to further embodiments which can be considered alone or in combination, the heater and/or the nozzle and/or the receiver and/or the converter may be connected for example by tube or by conveyor belts.

Alternatively, the heater and the nozzle may be a same device, in particular, the heater may be disposed around the nozzle such as for example an induction heater spiral.

Alternatively, the receiver 41 is disposed in the nozzle and/or the heater is disposed around the nozzle.

Alternatively, the heater and the nozzle and the receiver may be a same device.

Figure 4B:
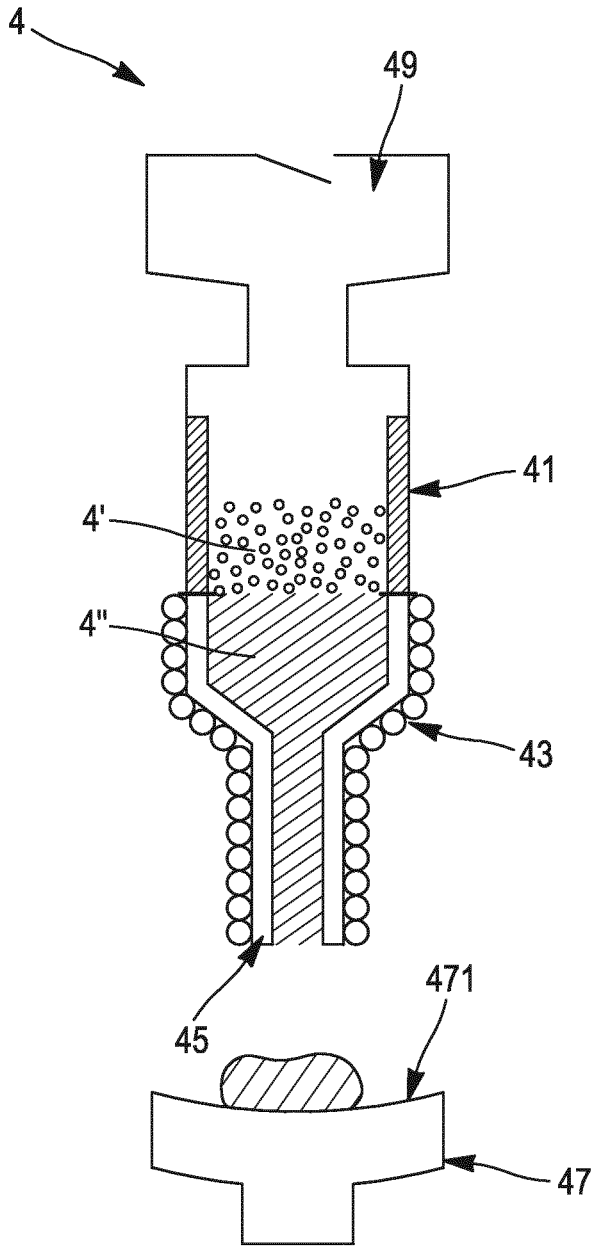

Alternatively, as illustrated in FIG. 4B, the receiver is disposed in the nozzle and the heater is disposed around the nozzle.

In one or more embodiments, the blocking system comprises further a measurement device 48 configured to measure at least one feature of the thermoplastic material.

The measurement device 48 may be arranged in the receiver, in the heater, in the nozzle or at the output of the nozzle.

The measurement device 48 may be a viscometer arranged at the output of the nozzle as illustrated FIG. 4B.

The measurement device may be a viscometer, consistometer or any similar device. Frequency of measurement must be adjusted according to the thermal degradation kinetics of the thermoplastic material. Ideally, the viscometer would be associated with the flowmeter in order to have a measurement for each lens. If this dynamic measurement is not implementable, a measurement every 20 optical elements would be recommended.

Although representative processes and devices have been described in detail herein, those skilled in the art will recognize that various substitutions and modifications may be made without departing from the scope of what is described and defined by the appended claims.

What is claimed is:

1. A blocking system, the blocking system comprising:

at least one blocking device comprising an insert having a surface configured to be blocked against a face of one optical element, a receiver configured to contain thermoplastic material in a solid state in a first particulate form, a heater configured to heat at least a part of the thermoplastic material at a temperature at which the thermoplastic material is in a melted state and flows under pressure, a nozzle configured to dispense the thermoplastic material in the melted state onto the surface of the insert, the thermoplastic material solidifying after the optical element is placed, thereby blocking the optical element on the insert, and a converter configured to convert the solidified thermoplastic material into a second particulate form, the converter being directly connected to the receiver.

2. The blocking system for blocking one optical element according to claim 1, further comprising:

a measurement device configured to measure at least one feature of the thermoplastic material.

3. The blocking system according to claim 2, wherein the measurement device is a viscometer.

4. The blocking system according to claim 1, further comprising a mixer configured to mix a first amount of thermoplastic material in the first particulate form and a second amount of the converted thermoplastic material in the second particulate form.

5. The blocking system according to claim 1, wherein the heater is configured to heat an amount of thermoplastic material to block less than 20 optical elements.

6. The blocking system according to claim 1, wherein the heater is configured to heat an amount of thermoplastic material to block a single optical element.

7. The blocking system according to claim 1, wherein the receiver is disposed in the nozzle and/or the heater is disposed around the nozzle.

8. The blocking system according to claim 1, wherein the converter is a thermal converter configured to convert the solidified thermoplastic material into a plurality of different particulate forms.

* * * * *